US007374070B2

(12) United States Patent
Dikes

(10) Patent No.: US 7,374,070 B2
(45) Date of Patent: May 20, 2008

(54) DEVICE FOR HANGING AND STORING UNDERGARMENTS AND METHOD THEREFOR

(76) Inventor: Rebecca Dikes, 5955 E. Shiprock St., Apache Junction, AZ (US) 85219

( * ) Notice: Subject to any disclaimer, the term of this patent is extended or adjusted under 35 U.S.C. 154(b) by 0 days.

(21) Appl. No.: 11/374,518

(22) Filed: Mar. 13, 2006

(65) Prior Publication Data

US 2007/0210124 A1 Sep. 13, 2007

(51) Int. Cl.
*A41D 27/22* (2006.01)

(52) U.S. Cl. ..... 223/85; 223/66; 206/278

(58) Field of Classification Search ..... 223/66, 223/68, 71, 85, 87, 88, 92, 98, 67, 69, 84, 223/120; D6/315, 316, 317, 318, 328; 206/278, 206/279, 284, 286, 287
See application file for complete search history.

(56) References Cited

U.S. PATENT DOCUMENTS 1,096,018 A * 5/1914 Buchwald ..... 223/92
1,502,457 A * 7/1924 Brecker ..... 223/68
1,863,511 A * 6/1932 Travis ..... 239/55
1,983,496 A * 12/1934 Ganz ..... 239/36
2,089,266 A * 8/1937 Kalvin ..... 211/85.3
2,132,734 A * 10/1938 Hart et al. ..... 383/102
2,265,789 A * 12/1941 Vivaudou et al. ..... 223/86
2,446,832 A * 8/1948 Insley ..... 223/68
2,462,778 A * 2/1949 Rosen ..... 223/94
2,529,125 A * 11/1950 Barbera ..... 223/67
2,529,294 A * 11/1950 Hammond, Jr. ..... 223/86
2,558,497 A * 6/1951 Rosen ..... 223/68
2,601,074 A * 6/1952 Walton ..... 223/86
2,669,375 A * 2/1954 Schilling ..... 223/68
2,676,735 A * 4/1954 Hellman ..... 223/66
2,745,578 A * 5/1956 Wexler et al. ..... 223/68
2,748,999 A * 6/1956 Freedman ..... 223/68
2,755,004 A * 7/1956 Schumacher ..... 223/66
2,814,424 A * 11/1957 Wexler et al. ..... 223/68
2,815,157 A * 12/1957 Badgley ..... 223/66
2,815,785 A * 12/1957 Vail ..... 383/13
3,075,677 A * 1/1963 Meisenberg ..... 223/68
3,164,309 A * 1/1965 Thompson et al. ..... 223/66
3,232,500 A * 2/1966 Milian et al. ..... 223/68
3,294,295 A * 12/1966 Wolf ..... 223/68
3,298,578 A * 1/1967 Shields ..... 223/67
3,837,476 A * 9/1974 Schwartz ..... 206/45.24
4,388,739 A * 6/1983 Martinon et al. ..... 8/150
D272,792 S * 2/1984 Marx ..... D6/316

(Continued)

FOREIGN PATENT DOCUMENTS

DE 4204898 A1 * 8/1993

(Continued)

*Primary Examiner*—Gary L. Welch
*Assistant Examiner*—Nathan E Durham
(74) *Attorney, Agent, or Firm*—Jeffrey D. Moy; Weiss & Moy, P.C.

(57) ABSTRACT

A hanger for a bra has a body section in a shape of a female torso. The body section has a front surface having a neck and a pair of concave members located below the neck. The concave members being formed in a predetermined cup size for retaining a shape of a bra positioned on the body section. A container is formed on a bottom

6 Claims, 3 Drawing Sheets

U.S. PATENT DOCUMENTS 4,542,838 A * 9/1985 Perez-Tubens et al. ..... 223/87
4,805,816 A * 2/1989 Freund ..... 223/66
4,949,842 A * 8/1990 Mokiao, II ..... 206/286
5,090,559 A * 2/1992 Gendreau ..... 206/278
5,244,131 A * 9/1993 Hollingsworth ..... 223/85
5,410,829 A * 5/1995 Schwab et al. ..... 40/414
D368,805 S * 4/1996 Hatakeyama ..... D6/315
D411,051 S * 6/1999 Hales ..... D6/316
6,196,429 B1 * 3/2001 Cavdek et al. ..... 223/68
6,234,368 B1 * 5/2001 DesForges et al. ..... 223/84
7,056,023 B2 * 6/2006 Heidel ..... 383/117
D536,179 S * 2/2007 Dikes ..... D6/316

FOREIGN PATENT DOCUMENTS

JP 11266991 A * 10/1999
JP 2001106277 A * 4/2001

* cited by examiner

DEVICE FOR HANGING AND STORING UNDERGARMENTS AND METHOD THEREFOR

FIELD OF THE INVENTION

The present invention relates to hangers and, more specifically, to a hanger having a body section in a shape of a female torso for permitting a bra, bikini top and the like to retain there shape.

BACKGROUND OF THE INVENTION

Presently, many bras, bikini tops, and the like (hereinafter bras) contain padding in the cup regions to provide a larger, fuller shape for the wearer. A problem with the padding is that the padding compresses and distorts in shape when the bra is washed and dried. The padding also compresses and distorts in shape when the bras are placed in drawers for storage or suitcases for travel since the padding becomes crushed and creased. The creases tend to remain in the bra and when worn under tight or knit clothing tend to show through the clothing. Consequently, the smooth and natural appearance desired from use of the padded bra is defeated.

Presently, there are different devices which allow one to hang a bra. U.S. Pat. No. 6,471,102 discloses a bra support device having a substantially rigid cup support portion having two concave cup portions. A substantially flat portion connects the concave cup portions. A device is used for retaining a bra in the cup portions. U.S. Pat. No. 4,805,816 discloses a combination garment display and hanger. The display has a molded plastic shell having a front face depicting at least part of a human torso. The shell further contains a hanger slot recessed into the upper part of the shell that is specifically contoured to complement display racks of various sizes and shapes.

While the above bra hangers do work, they both have drawbacks. The main problem with both designs is that neither hanger has storage space for placing the bras, matching undergarments, or other accessories. Another problem is that neither hanger comes with a device with allows the bras to be properly washed.

Therefore, there remains a need for a device to overcome the above problems. The device must prevent compression and creasing of the cups of bras during storage, shipment and hanging. The device must further provide storage space for placing matching undergarments or other accessories.

SUMMARY OF THE INVENTION

In accordance with one embodiment of the present invention, it is an object of the present invention to provide an improved hanger.

It is another object of the present invention to provide an improved bra hanger that overcomes the problems of the prior art.

It is still another object of the present invention to provide an improved bra hanger that prevents compression and creasing of the cups of bras during storage, shipment and hanging.

It is yet another object of the present invention to provide an improved bra hanger that provides storage space for placing matching undergarments or other accessories.

BRIEF DESCRIPTION OF THE EMBODIMENTS

In accordance with one embodiment of the present invention a hanger for a bra is disclosed. The hanger has a body section in a shape of a female torso. The body section has a front surface having a neck and a pair of concave members located below the neck. The concave members are formed in a predetermined cup size for retaining a shape of a bra positioned on the body section. A container is formed on a bottom area of the body section for storing the bra.

In accordance with another embodiment of the present invention a hanger for a bra is disclosed. The hanger has a body section having a shape of a torso. The body section has a front surface having a neck. A pair of concave members is formed on the body section below the neck. The concave members are formed in a predetermined cup size for retaining a shape of a bra. A container is formed on a bottom area of the body section. A rod member is coupled to the neck of the body section. The rod member runs approximately perpendicular to the neck. A hook is coupled to a central area of the rod member.

The present invention is best understood by reference to the following detailed description when read in conjunction with the accompanying drawings.

BRIEF DESCRIPTION OF THE DRAWINGS

Common reference numerals are used throughout the drawings and detailed description to indicate like elements.

DETAILED DESCRIPTION

Figure 1:
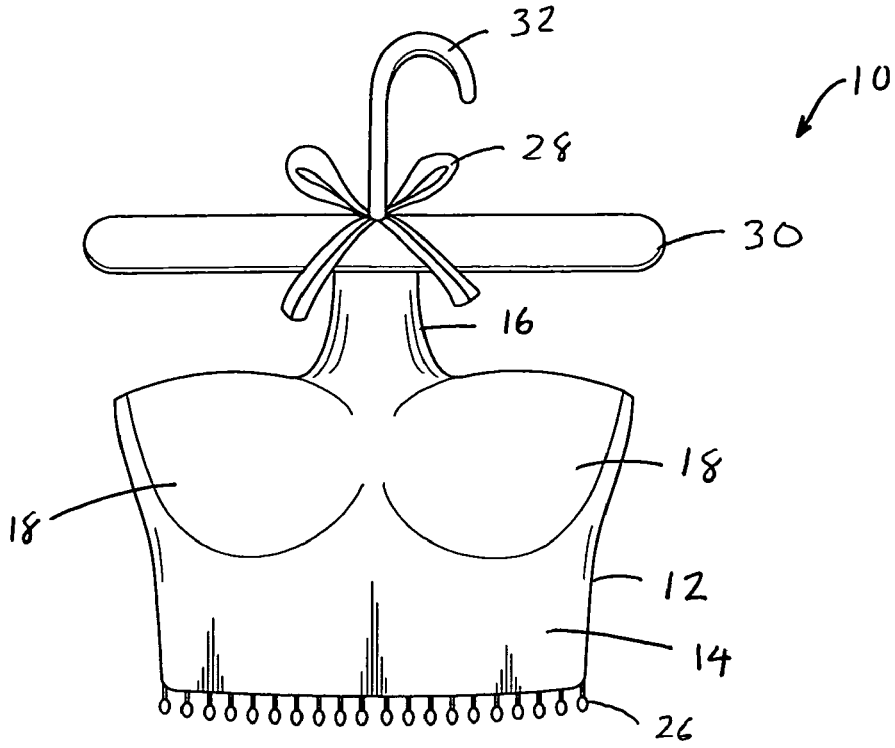
FIG. 1 is a front view of the bra hanger of the present invention.

Referring to the Figures a hanger 10 is shown. The hanger 10 allows a bra, bikini top and the like (hereinafter bra) to retain there shape. While the detailed description will use the term bra, it should be understood that the hanger 10 may be used with a bra, bikini top, and the like.

The hanger 10 has a body section 12. The body section 12 has a shape of a female torso. The body section 12 will have a front surface 14 which is molded from a single sheet of lightweight and durable material. In general, a high strength plastic or lightweight metal such as aluminum may be used. The listing of the above materials is given as an example and should not be seen as to limit the scope of the present invention.

The front surface 14 will have a neck section 16. Located below the neck section 16 is a pair of concave members 18 formed in the front surface 14. A concave member 18 is formed on either side and below the neck section 16. The concave members 18 are formed in a predetermined cup size. When a bra is placed over the concave members 18, the concave members 18 will help the bra retain its shape.

The concave members 18 will have a plurality of openings 20 formed therein. The openings 20 will allow the air to flow through the concave members 18. Thus, when a bra is placed on the concave members 18, air may flow through the bra and the concave members 18 thereby allowing the bra placed on the concave members 18 to dry and retain its shape.

A container 22 is formed on a bottom area of the body section 12. The container 22 is used for storing bras, undergarments, or other accessories. In accordance with one embodiment of the present invention, the container 22 will have a pair of side walls 22A which extend away from the front surface 14. In the embodiment depicted in the Figures, the side walls 22A are curved. However, this is only given as an example and should not be seen as to limit the scope of the present invention. A rear wall 228 is coupled to both of the side walls 22A to form an enclosure. The enclosure is oval in shape and similar to the shape of a torso of a body. However, again, this is only given as an example and should not be seen as to limit the scope of the present invention. A bottom panel 22C is coupled to the front surface 14, side walls 22A, and rear wall 228 to form the container 22. The container 22 is generally an open container. However, a top may be placed on the container 22 without departing from the spirit and scope of the present invention.

Figure 2:
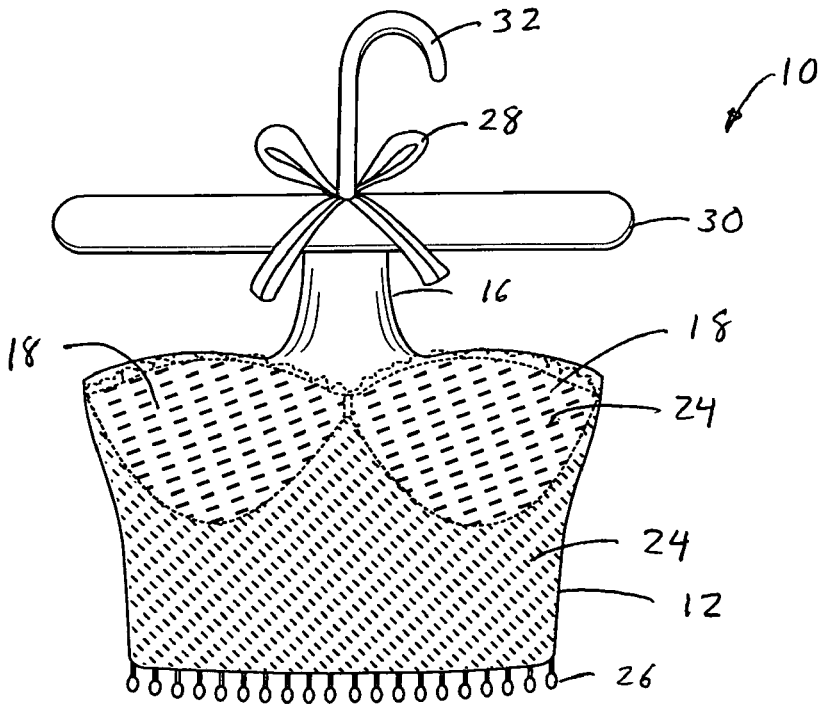
FIG. 2 is a front view of the bra hanger of the present invention having a covering.
Figure 3:
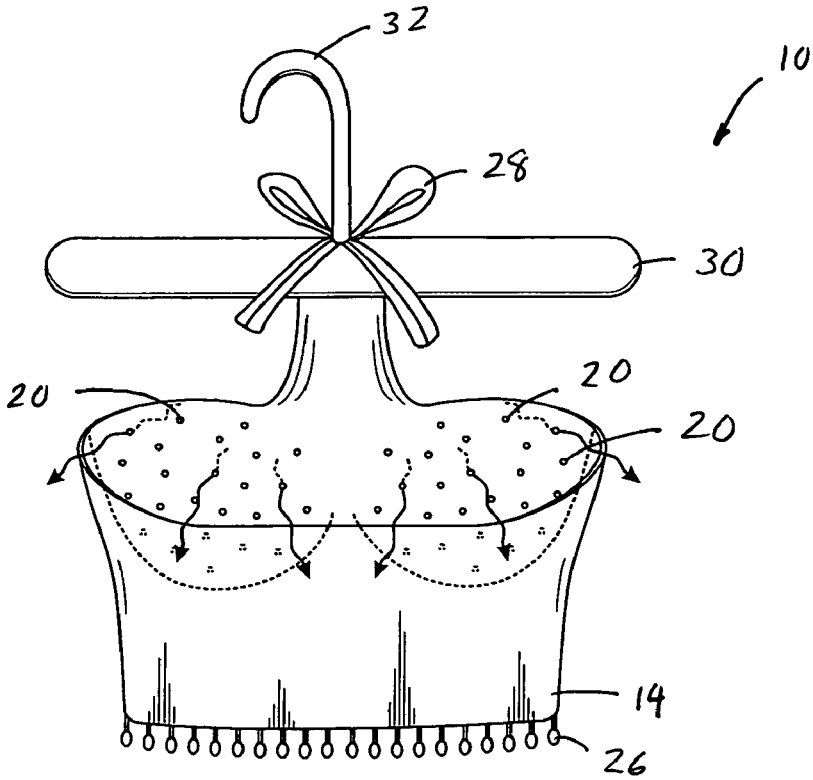
FIG. 3 is a front view of the bra hanger showing the ventilation openings.
Figure 4:
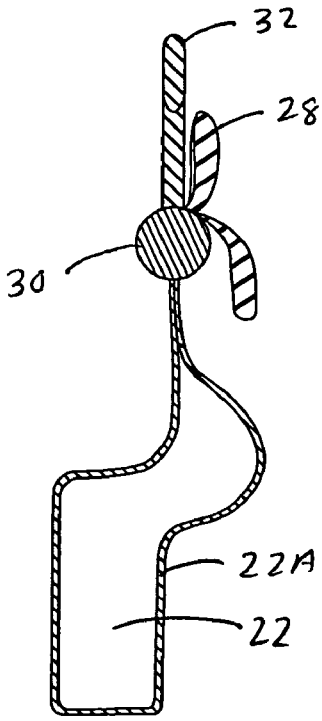
FIG. 4 is a cross-sectional side view of the bra hanger.
Figure 5:
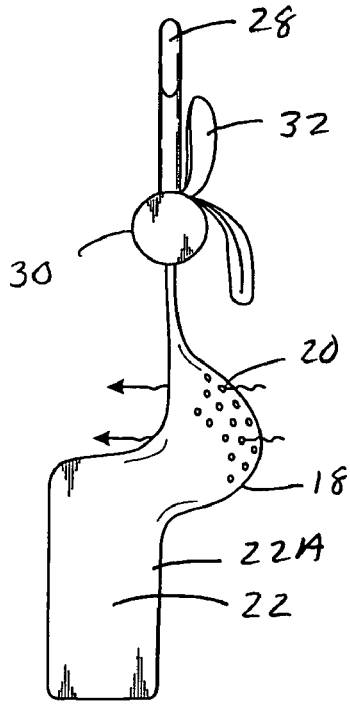
FIG. 5 is aside view of the bra hanger.
Figure 6:
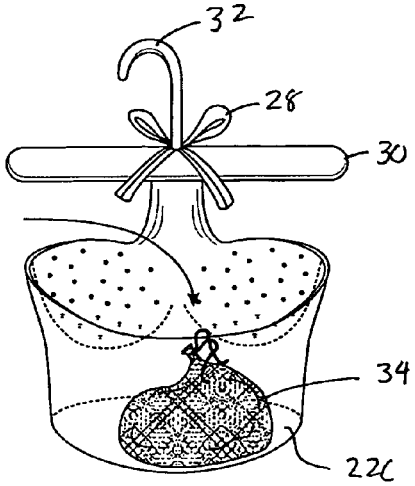
FIG. 6 is a see through rear view of the bra hanger showing the interior of the storage area.
Figure 6A:
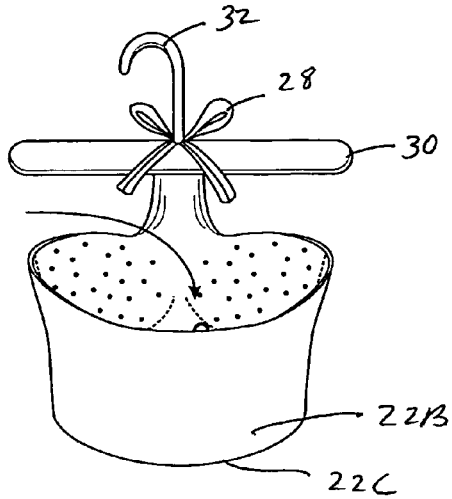
FIG. 6A is a rear view of the bra hanger.
Figure 7:
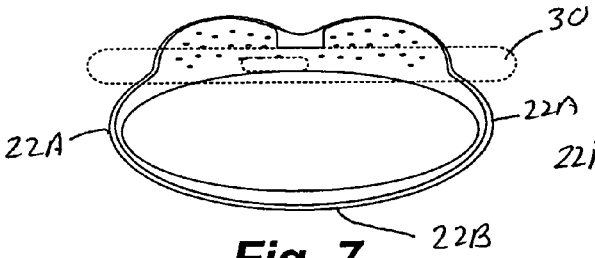
FIG. 7 is atop view of the bra hanger with a rod member of the hanger in phantom lines.
Figure 7A:
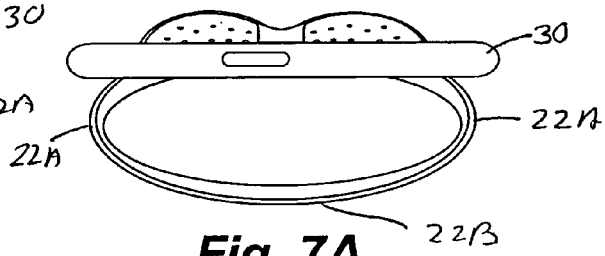
FIG. 7A is a top view of the bra hanger.
Figure 8:
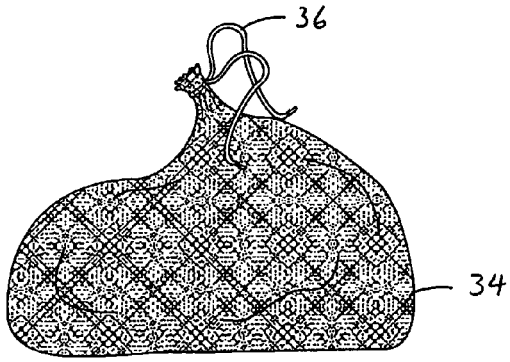
FIG. 8 is a front view of a garment bag used with the bra hanger of the present invention.

The front surface 14 and the container 22 may be covered with a fabric 24 as shown in FIG. 2. The fabric 24 will allow the hanger 10 to have the appearance of a corset. The fabric 24 should generally be made of a thin material or a mesh material. This will allow air to flow through the fabric 24 as well as the concave members 18 thereby allowing the bra to breathe when placed on the hanger 10. Beading 26 may also be coupled to the hanger 10. As shown in FIG. 1-3, beading 26 may extend down from the container 22. The beading 26 may extend around the bottom perimeter of the container 22 or may be placed just on a front bottom area of the container 22. The beading 26 will further enhance the corset appearance of the hanger 10. Other decorative features may be coupled to the hanger 10 to enhance the corset look of the hanger 10. A ribbon 28 or other decorative items may be coupled to the hanger 10.

A rod member 30 is coupled to the body section 12. The rod member 30 will run perpendicular to a top surface of the body section 12. The rod member 30 will generally be similar in length to the width of the body section 12. The rod member 30 is used to hold the strap of an item placed on the hanger 10. Thus, for example, the bra straps may be placed on the rod member 28 while the remaining portion of the bra is strapped around the body section 12.

A hook 32 will extend out of a top surface of the rod member 30. The hook 32 will allow the hanger 10 to be hung. The hook 32 will be centrally located on the rod member 30. By having the hook 32 extend out of a top central area of the rod member 30, the hanger 10 will be balanced when hung. It should be noted that the bottom panel 22C of the container 22 will allow the hanger 10 to stand in an upright position. Thus, the hanger 10 does not have to be hung.

The hanger 10 may come with a small wash bag 34. The wash bag 34 will allow a person to place her bras or any other delicates in the wash bag 34 before placing the bras/delicates in the washing machine. The wash bag 34 will protect the bras/delicates from being ripped/damaged by a washing machine. The wash bag 34 may be placed in the container 22 for storage. The wash bag 34 is generally made out of a mesh material. A drawstring 36 is placed on top to keep items in the wash bag 34.

In use, one or more bras will be placed in the wash bag 34. The wash bag 34 will be closed by pulling the draw string 36. The wash bag is then placed in a washing machine so that the bras are washed. A bra is then placed on the hanger 10. The bra is placed on the hanger so that the cups of the bra are placed on the concave members 18. The concave members 18 will have a plurality of openings 20 formed therein. The openings 20 will allow the air to flow through the concave members 18. Thus, when a bra is placed on the concave members 18, air may flow through the bra and the concave members 18 thereby allowing the bra placed on the concave members 18 to dry and retain its shape. Once the bra is dry, the bra is placed in the container 22 for storage.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. A hanger for a bra and the like comprising:

a body section having a front surface molded from a single sheet of material, the front surface having a neck and a pair of concave members located below the neck, the concave members having a plurality of openings to allow air to flow through the concave members and being formed in a predetermined cup size for retaining a shape of a bra positioned on the body section;

a container formed on a bottom area of the body section to form a torso of the body section, wherein the container comprises:

a pair of side walls coupled to the bottom area of the body section;

a rear wall coupled to the side walls; and a bottom panel coupled to the pair of side walls, and the rear wall to form the container having an open top to store accessories;

a rod member attached to a top surface of the neck of the body section and running approximately a length of the body section;

a hook member extending from a central area of the rod member;

a fabric material covering the body section and the container and having an appearance of a corset, the fabric covering the container concealing the accessories in the container, the fabric material being allowing air to flow through the concave members of the body section; and a wash bag formed of a mesh material and having a draw string stored in the container section when not in use for placing a bra to be washed to protect the bra from being damaged during washing.

2. A hanger for a bra in accordance with claim 1 further comprising beading coupled around an outer perimeter of the container, the beading further enhancing the appearance of the corset.

3. A hanger for a bra and the like comprising:

a body section having a shape of a torso, the body section having a front surface having a neck;

a pair of concave members formed on the body section below the neck, the concave members being formed in a predetermined cup size for retaining a shape of a bra positioned on the body section;

a container formed on a bottom area of the body section for storing accessories within the container, wherein the container comprises:

a pair of curved side walls coupled to the bottom area of the body section;

a rear wall coupled to the side walls; and a bottom panel coupled to the pair of side walls, and the rear wall to cover a bottom area of the container, the container having an open top;

a rod member coupled to the neck of the body section, the rod member running approximately perpendicular to the neck; and a hook coupled to a central area of the rod member a fabric material covering the body section and the container and having an appearance of a corset, the fabric covering the container concealing the accessories in the container, the fabric material being allowing air to flow through the concave members of the body section; and a wash bag formed of a mesh material and having a draw string stored in the container section when not in use for placing a bra to be washed to protect the bra from being damaged during washing.

4. A hanger for a bra in accordance with claim 3 further comprising a plurality of perforations formed through the concave members to allow air to flow through the concave members.

5. A hanger for a bra in accordance with claim 3 wherein the container comprises an oval container coupled to the bottom area of the body section and having an open top.

6. A hanger for a bra in accordance with claim 3 further comprising beading coupled around an outer perimeter of the container, the beading further enhancing the appearance of the corset.

* * * * *